US007569003B1

(12) United States Patent
Huffman

(10) Patent No.: US 7,569,003 B1
(45) Date of Patent: Aug. 4, 2009

(54) ABDOMINAL AND BODY EXERCISE DEVICE

(76) Inventor: Larry D. Huffman, 304 Trelawney La., Cary, NC (US) 27519

( * ) Notice: Subject to any disclaimer, the term of this patent is extended or adjusted under 35 U.S.C. 154(b) by 928 days.

(21) Appl. No.: 10/728,961

(22) Filed: Dec. 8, 2003

Related U.S. Application Data

(60) Provisional application No. 60/431,201, filed on Dec. 6, 2002.

(51) Int. Cl.
*A63B 21/008* (2006.01)

(52) U.S. Cl. ..... 482/112; 482/111; 482/113

(58) Field of Classification Search ..... 482/92, 482/111–113, 121–123; 600/587, 595
See application file for complete search history.

(56) References Cited

U.S. PATENT DOCUMENTS

| | | | | | |
|---|---|---|---|---|---|
| 3,471,145 | A | | 10/1969 | Berger | |
| 3,834,696 | A | * | 9/1974 | Spector | 482/112 |
| 4,148,479 | A | | 4/1979 | Spector | |
| 4,290,599 | A | | 9/1981 | Berger | |
| 4,333,645 | A | * | 6/1982 | Wu | 482/112 |
| 4,351,527 | A | | 9/1982 | Crisp, Jr. | |
| 4,489,937 | A | | 12/1984 | Kong | |
| 4,517,966 | A | | 5/1985 | von Othegraven | |
| 4,580,778 | A | | 4/1986 | Van Noord | |
| 4,591,032 | A | | 5/1986 | Itazu | |
| 4,856,776 | A | | 8/1989 | Ching-Liang | |
| 4,880,230 | A | * | 11/1989 | Cook | 482/113 |
| 4,951,941 | A | * | 8/1990 | Resk | 482/112 |
| 4,981,199 | A | | 1/1991 | Tsai | |
| 5,046,726 | A | | 9/1991 | Van Straaten | |
| 5,069,448 | A | | 12/1991 | Shyu | |
| 5,071,119 | A | | 12/1991 | Johnson | |
| 5,178,160 | A | * | 1/1993 | Gracovetsky et al. | 600/595 |
| 5,232,425 | A | | 8/1993 | Miller et al. | |
| 5,346,451 | A | | 9/1994 | Miller | |
| D357,951 | S | | 5/1995 | Chen | |
| 5,529,559 | A | * | 6/1996 | Punzalan | 482/112 |
| 5,803,879 | A | * | 9/1998 | Huang | 482/112 |
| 5,954,622 | A | * | 9/1999 | Olschansky et al. | 482/123 |

* cited by examiner

*Primary Examiner*—Glenn Richman
(74) *Attorney, Agent, or Firm*—James Creighton Wray

(57) ABSTRACT

An exercise device has two identical, parallel, solid, metal bars connected by an adjustable resistance hydraulic cylinder. The hydraulic cylinder is attached to the lower metal bar while the piston is connected to the upper metal bar. Oversized, cushioned grips are attached to both the upper and lower metal bars for comfort and increased gripping ability. A multi-staged resistance adjustment device is located on the upper end of the hydraulic cylinder. The oil or air filled hydraulic cylinder provides resistance in both the push and pull motions. Various body positions are facilitated to target specific muscle groups. Exercises include abdominal crunches, bicep curls, triceps presses, chest flies, upright rows and leg squats.

20 Claims, 6 Drawing Sheets

ABDOMINAL AND BODY EXERCISE DEVICE

This application claims the benefit of U.S. Provisional Application No. 60/431,201, filed Dec. 6, 2002.

BACKGROUND OF THE INVENTION

There are many devices sold with the purpose of exercising abdominal and other muscle groups. However, previous devices have been large and costly.

Additionally, previous exercise devices are not as effective as possible because they lack adjustable resistance. Adjustable resistance is a key element in successful strength training. Without adjustable resistance, each individual operator cannot vary his or her use to specific physical conditions. Moreover, previous devices that utilize springs do not provide adequate resistance in both the compression and expansion stages of operation.

Other problems with existing exercise devices include difficulty of use and discomfort during operation. Back problems are especially problematic during abdominal exercise because of the stress placed on the lower spine. Many devices on the market today inadvertently target other muscle groups, such as hip flexures, and not the abdominal muscles.

Needs exist for improved exercise devices that target specific muscle groups, have readily adjustable resistance settings, and are safe and comfortable during operation.

SUMMARY OF THE INVENTION

The present invention is an exercise device that targets specific muscle groups, such as abdominal, hips, lower back, arms and chest. Many various body positions, used for exercising many different muscle groups, are facilitated by the present invention. The exercise device is portable and easy to store when compared to previous exercise devices.

The exercise device has two solid, metal bars connected by an adjustable resistance hydraulic or pneumatic cylinder. The hydraulic or pneumatic cylinder is filled with oil or air, and no springs are involved. The hydraulic cylinder is connected to the lower bar, and the piston is connected to the upper bar. The metal bars are covered in oversized, padded material that improves grip and reduces contact pressure.

A multi-stages resistance adjustment device located on one end of the hydraulic or pneumatic cylinder changes the resistance of the exercise device. The exercise device utilizes both push and pull resistance to work muscle groups. Because there is no spring, muscle groups are worked on both the expansion and compression phases of each repetition.

A preferred exercise apparatus first and second spaced parallel bars, a cylinder having first and second ends and a ram having a piston mounted in the cylinder and having a piston rod connected at a first end to the piston, extending through the second end of the cylinder.

The first end of the cylinder is connected centrally on the first bar and the piston rod has a second end connected centrally on the second bar. Resistance between the piston and the first and second ends of the cylinder resists movement of the piston and piston rod in either direction with respect to the cylinder.

Grips on at least one of the bars provides for gripping the bar with one or two hands of a user.

Positions are provided on the other bar for holding the other bar with one or both hands or under body members.

Fluid in the cylinder on opposite sides of the piston resists flowing between opposite sides of the piston as the piston is moved through the cylinder.

Preferably the resistance is adjustable by varying flow rate of the fluid between the opposite side of the piston.

The resistance is variable in response to varying force between the bars for extending the piston rod from the cylinder and moving the piston rod into the cylinder. The resistance is variable in response to varying speed between the bars for extending the piston rod from the cylinder and moving the piston rod into the cylinder.

Preferably the fluid is oil, and the cylinder is a hydraulic cylinder.

Alternatively, the fluid is air, and the cylinder is a pneumatic cylinder.

A flow passage in the cylinder between sides of the piston and a restrictor on the passage restrict flow. Preferably the restrictor is adjustable.

In one preferred form of the exercise apparatus, a double-acting sealed hydraulic or pneumatic cylinder has opposite first and second ends. The first end is closed and the second end has an opening with a seal for permitting sliding movement of a ram therethrough. Fluid is sealed in the cylinder;

A ram is mounted in the cylinder. The ram has a piston on a first end disposed within the cylinder. A second end of the ram extends from the cylinder. Moving the ram and increasing force in a fluid medium in one end of a cylinder forces fluid from the one end of the cylinder to the other end.

A passage between the ends of the cylinder and a restriction in the passage controls resistance to flow of fluid between opposite ends of the cylinder.

A first mounting ring is provided on the first end of the cylinder. A second mounting ring is on the second end of the ram. A first handle extends through the first mounting ring and has opposite equal length ends of the first handle on opposite sides of the first ring.

A second handle extends through the second ring and has opposite equal length ends of the second handle on opposite sides of the second ring. Foam padded handle grips are mounted on the ends of the first and second handles.

A preferred method of exercising includes gripping handles, relatively moving handles away from and toward each other and directly forcing a ram directly connected to one of the handles into and out of a hydraulic or pneumatic cylinder directly connected to the other one of the handles, and moving hydraulic or pneumatic fluid against resistance from one end to the other end of the cylinder with the relative movement of the handles and of the ram and the cylinder.

A preferred method grips first pair of handles on opposite ends of a first bar placed through a first ring on a closed end of the cylinder and grips a second pair of handles on opposite ends of a second bar placed through a second ring on an outer end of the ram.

In one exercise the first pair of handles comprises placing the first pair of handles under knees of a user in a seated position. The second pair of handles is gripped with hands of a user near a chin. Holding the hands in relative position to the chin and moving the first pair of handles by alternately bending a user's trunk forward and raising the trunk against fluid resistance of movement in the cylinder by the ram exercises the user's abdominal muscles.

In one exercise, placing the first pair of handles under knees of a user in a seated position and gripping the second pair of handles with hands, palms facing inward, while holding a user's back straight and elbows stationary, raising and lowering the first pair of handles against fluid resistance of movement in the cylinder by the ram exercises the user's biceps.

In the same exercise with palms facing outward, and holding a user's back straight and elbows stationary, lowering and raising the first pair of handles against fluid resistance of movement in the cylinder by the ram exercises the user's triceps.

Placing the first pair of handles under feet of a user in a standing position and gripping the second pair of handles with hands, palms facing inward and knees slightly flexed, and raising and lowering the second pair of handles by lifting and lowering the user's back against fluid resistance of movement in the cylinder by the ram exercises back and abdominal muscles in an upright rowing exercise.

Placing the first pair of handles under feet of a user in a seated position and gripping the second pair of handles with hands behind the user's knees and squatting and straightening the user's legs against fluid resistance of movement in the cylinder by the ram provides a squat exercise.

In chest flies, gripping the first pair of handles with one hand near the first ring and gripping the second pair of handles with the other hand near the second ring, palms facing inward, exercises chest and back muscles by pushing the first and second pairs of handles toward each other and pulling the first and second pairs of handles away from each other against fluid resistance of movement in the cylinder by the ram.

Twisting a collar on the cylinder in staged resistance steps adjusts resistance in the cylinder.

Examples of exercises that can be performed using the present invention include abdominal crunches, bicep curls, tricep presses, chest flies, upright rowing and leg squats.

These and further and other objects and features of the invention are apparent in the disclosure, which includes the above and ongoing written specification, with the claims and the drawings.

DETAILED DESCRIPTION OF THE PREFERRED EMBODIMENTS

The present invention is an abdominal and body exercise device that targets specific muscle groups for various exercises. Multiple hand placements and body positions, in relation to the exercise device, allow for exercise of different muscle groups. Muscle groups that can be exercised using the present invention include abdominal, hips, lower back, arms and chest.

Figure 1:
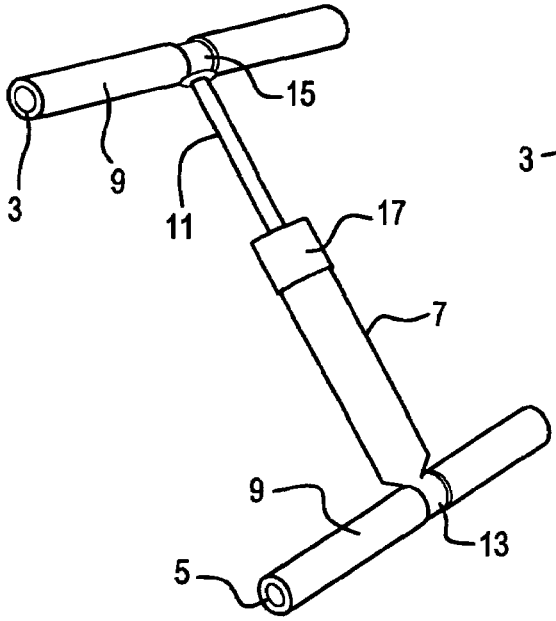
FIG. 1 is a perspective view of the abdominal and body exercise device.

As shown in FIG. 1, the abdominal and body exercise device has two identical, solid metal bars 3, 5 connected by an adjustable resistance hydraulic or pneumatic cylinder 7. The upper bar 3 acts as a padded grip or handle for hands or other body parts. The lower bar 5 acts as a padded base. This lower bar 5 acts as a padded base that can be stabilized between and under the thigh areas of the body while operating the device in a seated position. The lower bar acts as a base stabilized under an operator's feet during standing operation. The hydraulic cylinder 7 is an oil or air filled cylinder. There are no springs involved. Therefore, the exercise device has both push and pull resistance. Resistance exists for both the expansion and contraction phase of each exercise repetition.

Large, oversize foam padded handles 7 cover the solid metal bars 3, 5. These handles 7 provide padding and improved grip and spread contact area to reduce localized pressures during exercise.

The hydraulic cylinder 7 is attached to the lower bar 5 by a ring 13. The piston 11 is connected to the upper bar 3 at connection 15, which is also a ring. Preferably, the bars are welded and/or press fit in interference with the rings for rigidity.

The resistance of the exercise device is adjusted using a multi-staged resistance adjustment device 17 located on the upper portion of the hydraulic cylinder 7. The resistance adjustment device 17 is rotated in pre-selected steps, changing, promoting or resisting flows to change resistance levels from minimum to maximum. Alternatively, the rotatable resistance element may pre-compress a spring to change resistance loads and relatively increase or decrease loads in extension or compression. For example, lightening loads on downward movement during bicep curls.

Figure 2:
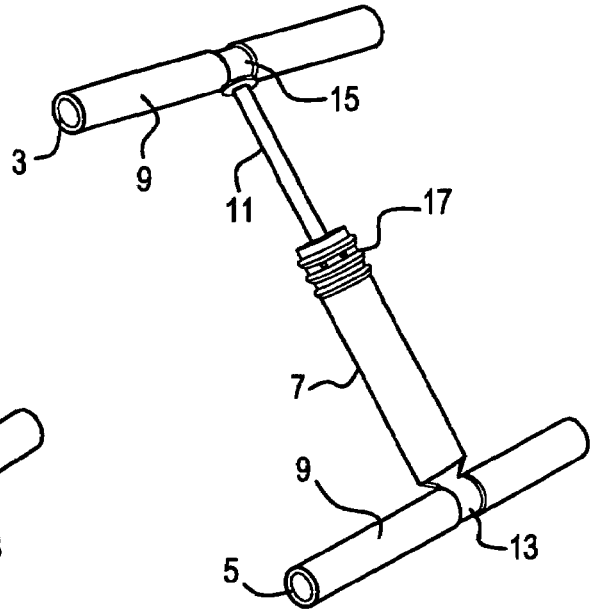
FIG. 2 is a photograph of the abdominal and body exercise device.

FIG. 2 shows a photograph of the exercise device. The exercise device is relatively small compared to traditional, bulky exercise equipment. The exercise device can be easily stored in homes and apartments and is portable. The new exercise device is solid and heavy to assure professional quality workouts.

Figure 3:
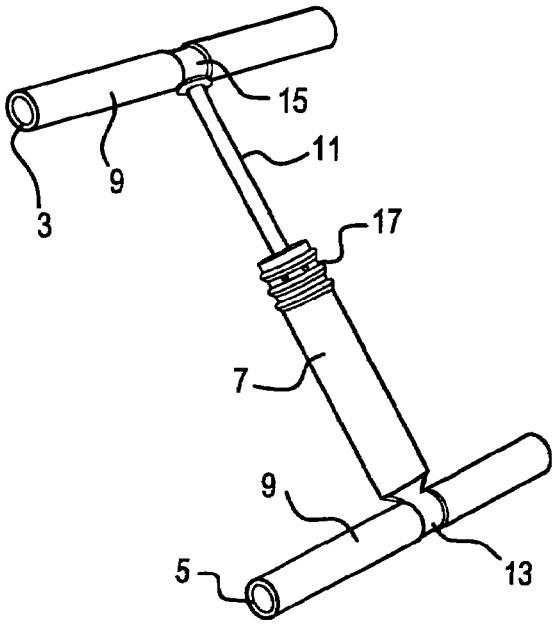
FIG. 3 is a photograph of the fully extended exercise device.

FIG. 3 shows the exercise device in a fully extended position with the piston 11 pulled from the hydraulic cylinder 7 to its maximum length.

Figure 4:
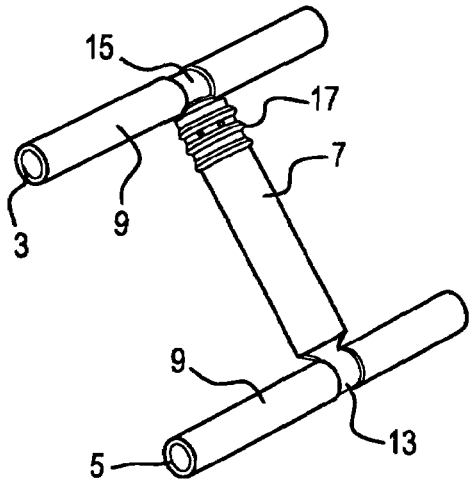
FIG. 4 is a photograph of the fully compressed exercise device.
Figure 6A:
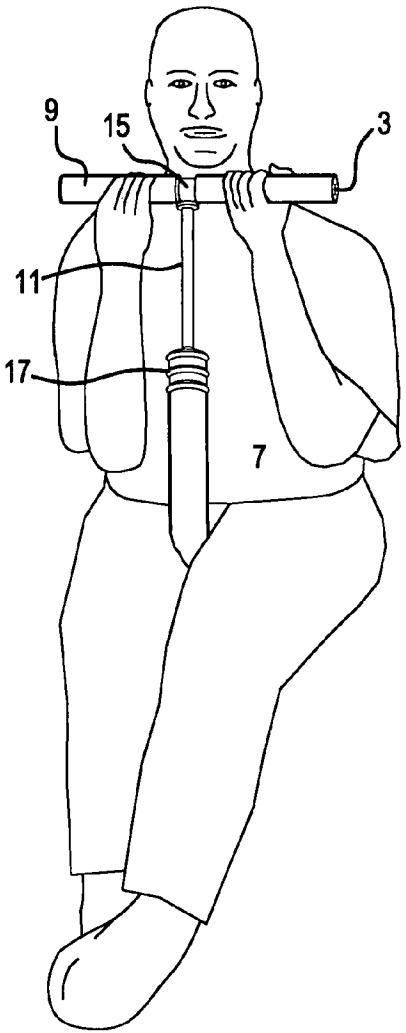
FIGS. 6*a* and 6*b* are frontal-view illustrations of the exercise device being used for abdominal crunches.
Figure 5B:
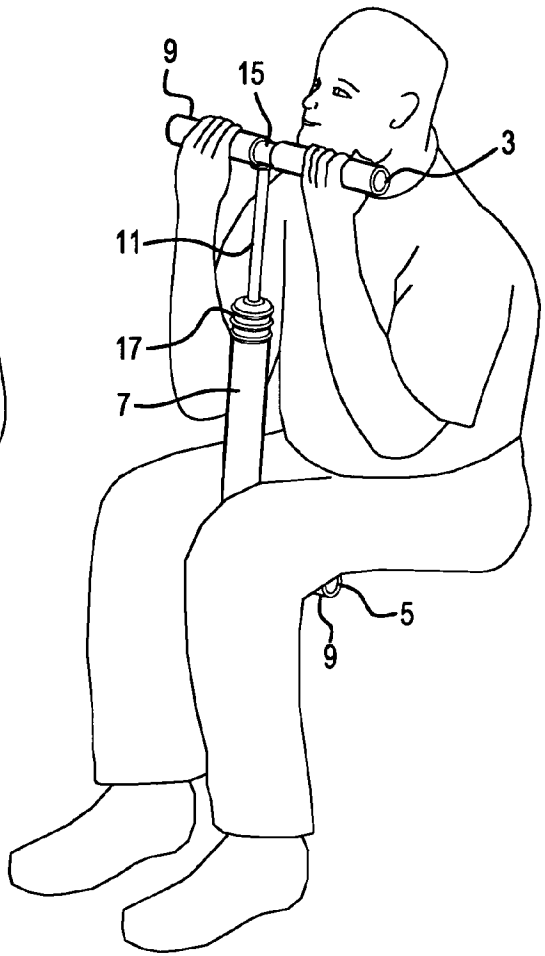
FIGS. 5*a* and 5*b* are diagonal-view illustrations of the exercise device being used for abdominal crunches.
Figure 5A:
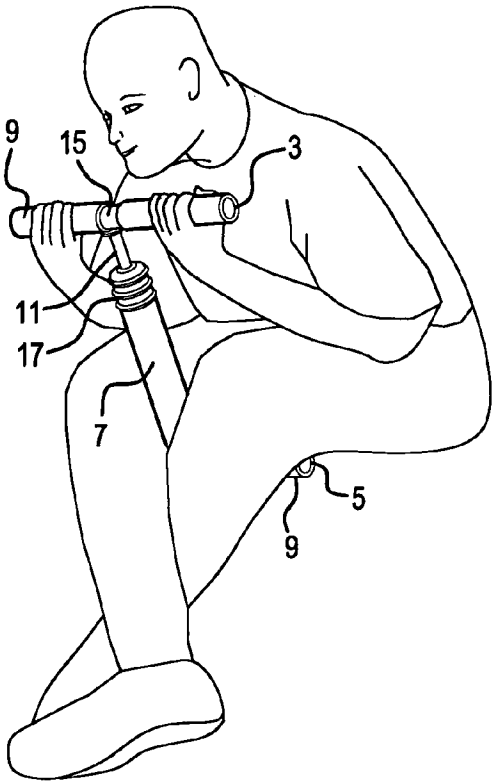

The fully compressed exercise device, with the piston 11 completely inside the hydraulic cylinder 7, is shown in FIG. 4.

The remaining Figures are illustrations of some of the various exercises that are facilitated by the exercise device.

FIGS. 5*a*, 5*b*, 6*a* and 6*c* show the exercise device being used as an abdominal crunch machine. To use the present invention for abdominal crunches, the lower bar 5 is secured under the thigh areas of the operator. The operator's hands grip the upper bar 3 from underneath. The operator rocks forward and back against the resistance of the exercise device, holding upper and lower arms and wrists locked and keeping hand and arm movement to a minimum.

Figure 7B:
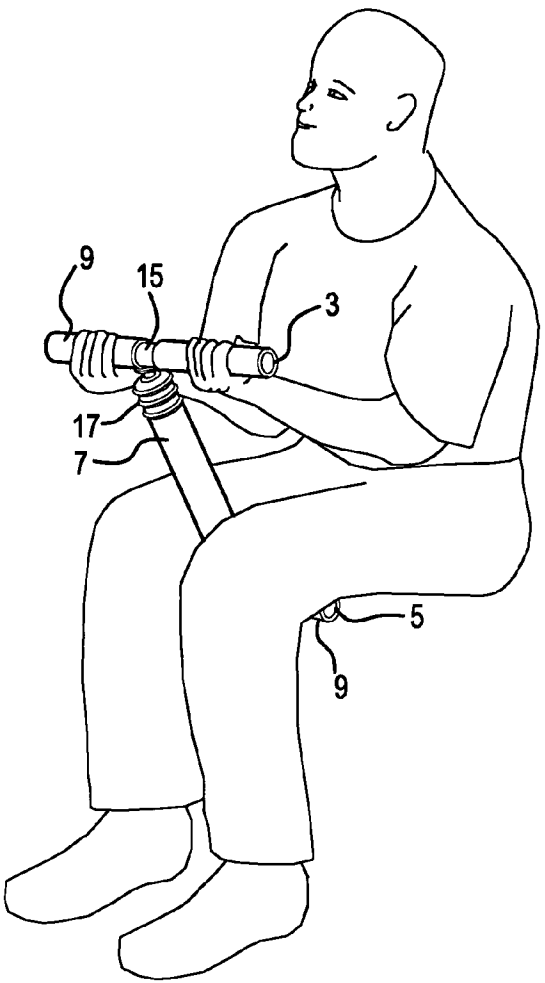
FIGS. 7*a* and 7*b* are illustrations of the exercise device being used for bicep curls.
Figure 7A:
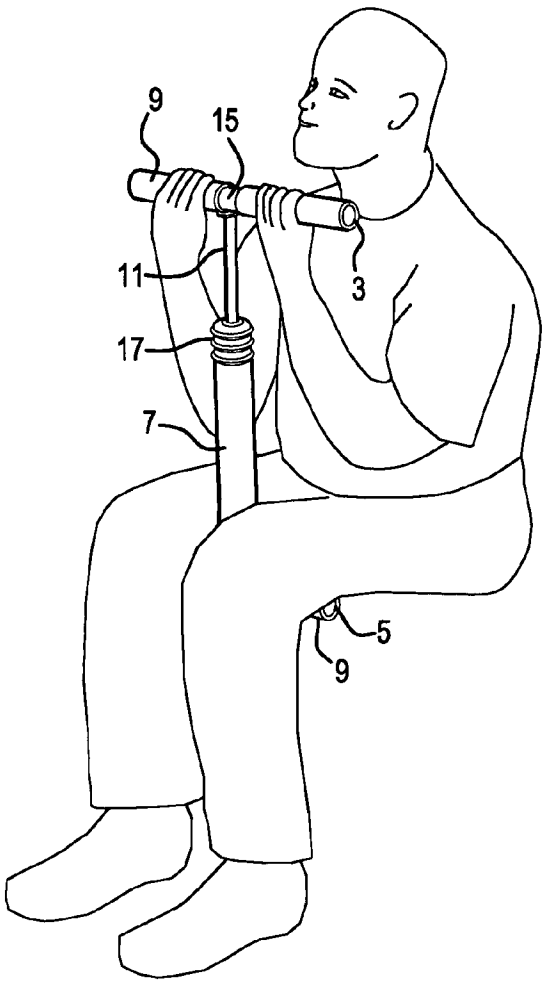
Figure 6B:
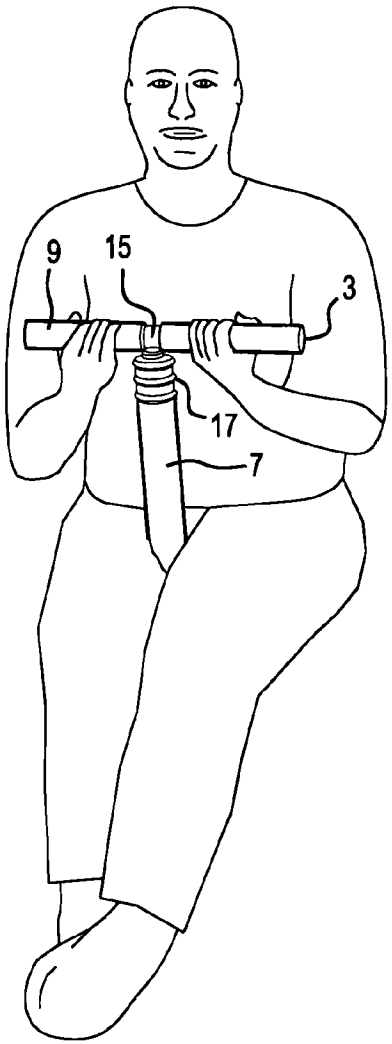

FIGS. 7*a* and 7*b* illustrate a bicep curl machine. To perform bicep curls with the present invention, the operator secures the lower bar 5 under the thigh areas. As in the abdominal crunches, the operator grips the upper bar 3 from underneath. The operator, keeping a straight back, pulls the piston 11 from the resistance cylinder 7 by bringing the upper bar 3 towards the operator's chest. For the compression stage, the operator pushes against the resistance until the piston 11 is completely inside the resistance cylinder 7. The process is repeated for the desired number of repetitions.

Figure 8B:
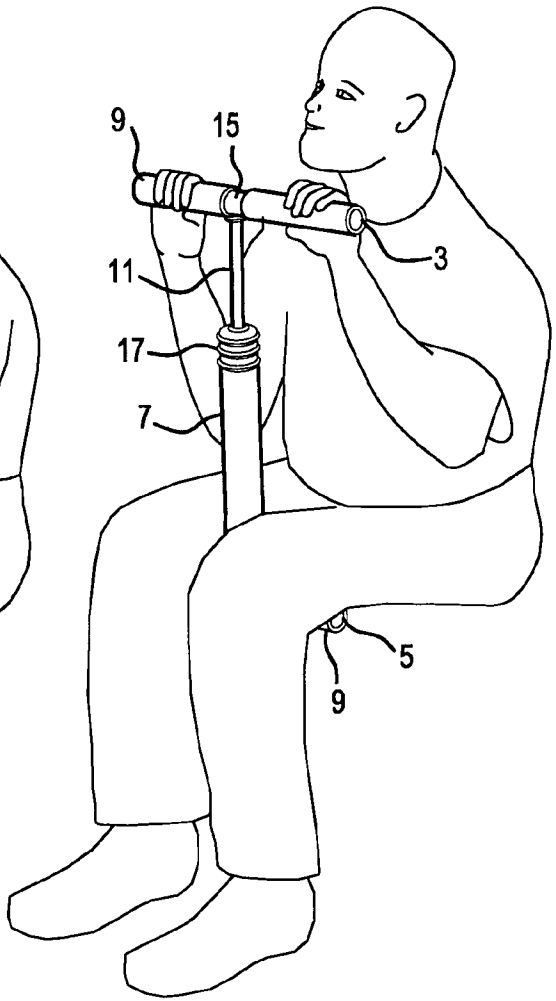
FIGS. 8*a* and 8*b* are illustrations of the exercise device being used for tricep presses.
Figure 8A:
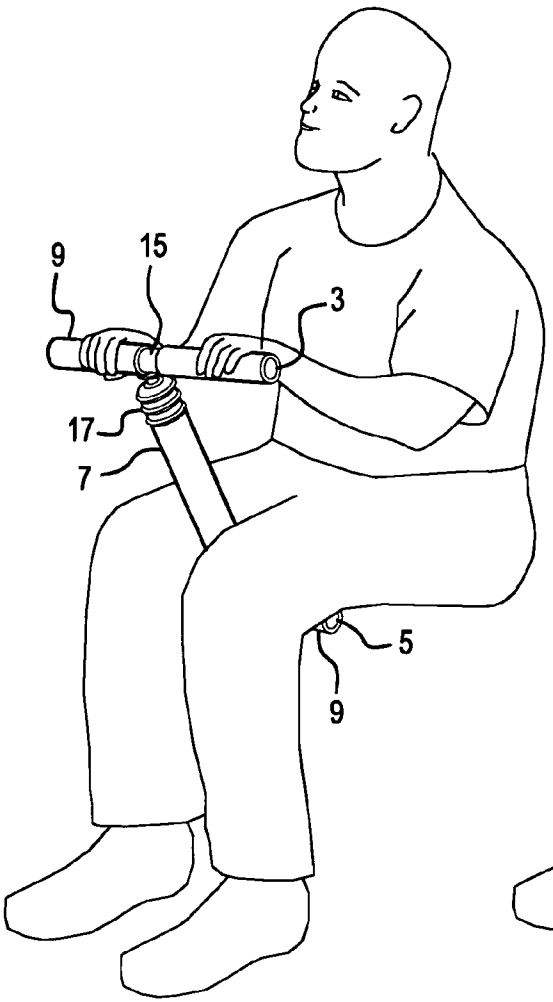

FIGS. 8*a* and 8*b* show a triceps press machine. To perform triceps curls with the present invention, the operator secures the lower bar 5 under the thigh areas. In contrast to the abdominal crunches and bicep curls, the operator grips the upper bar 3 from above. The operator, keeping a straight back, pulls the piston 11 from the resistance cylinder 7 by raising the upper bar 3 vertically toward the operator's face. For the compression stage, the operator pushes downward against the resistance until the piston 11 is completely inside the resistance cylinder 7. The process is repeated for the desired number of repetitions.

Figure 9A:
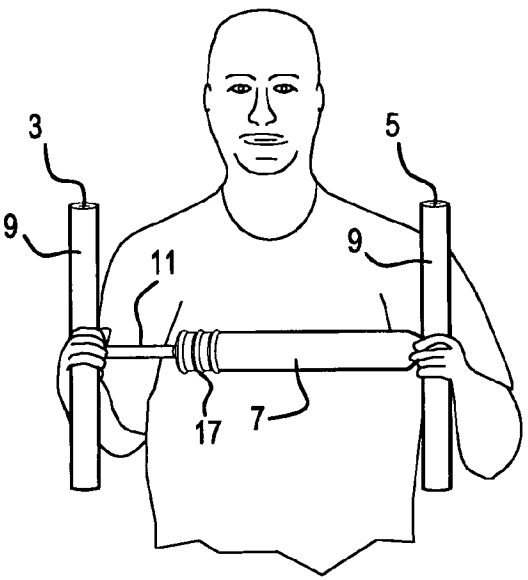
FIGS. 9*a* and 9*b* are illustrations of the exercise device being used for chest flies.
Figure 9B:
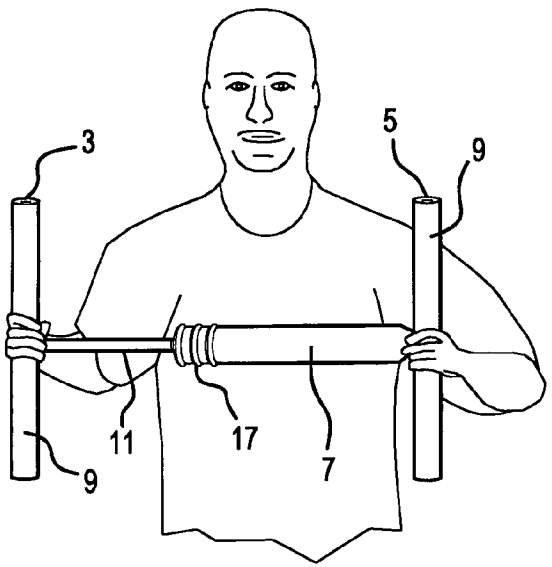

FIGS. 9*a* and 9*b* show a chest fly machine. To perform chest flies with the present invention, the piston 11 is pulled from the cylinder 7. The operator holds the upper bar 3 in one hand and the lower bar 5 in the opposite hand. The piston 11 and cylinder 7 stretch and compress horizontally in front of the operator's chest. The operator pushes the piston 11 into the resistance cylinder 7 by bringing force and applying pressure from both hands towards the center of the operator's chest. For the expansion stage, the operator pulls horizontally against the resistance until the piston 11 is completely extended. The process is repeated for the desired number of repetitions.

Figure 10A:
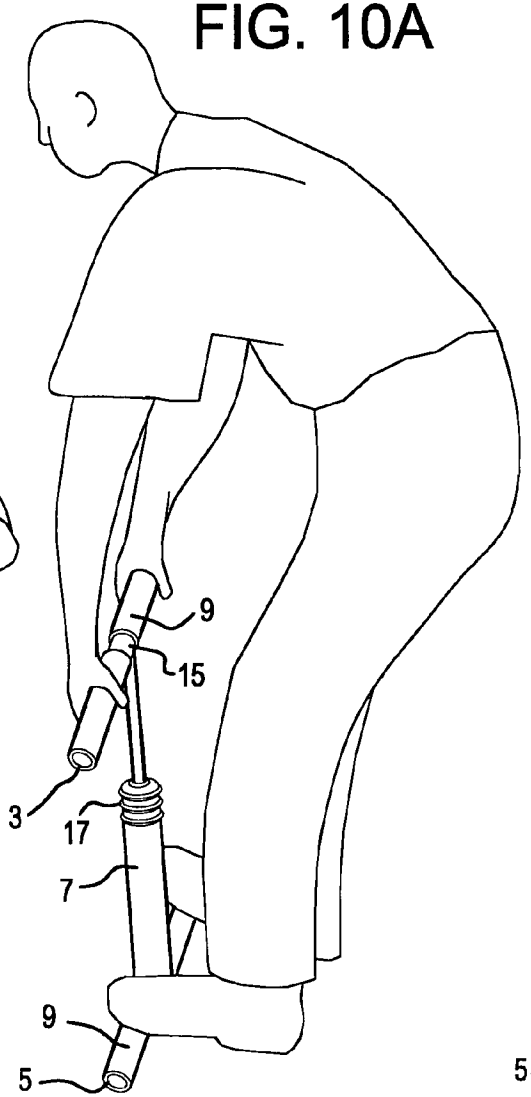
FIGS. 10*a* and 10*b* are illustrations of the exercise device being used as an upright rowing machine.
Figure 10B:
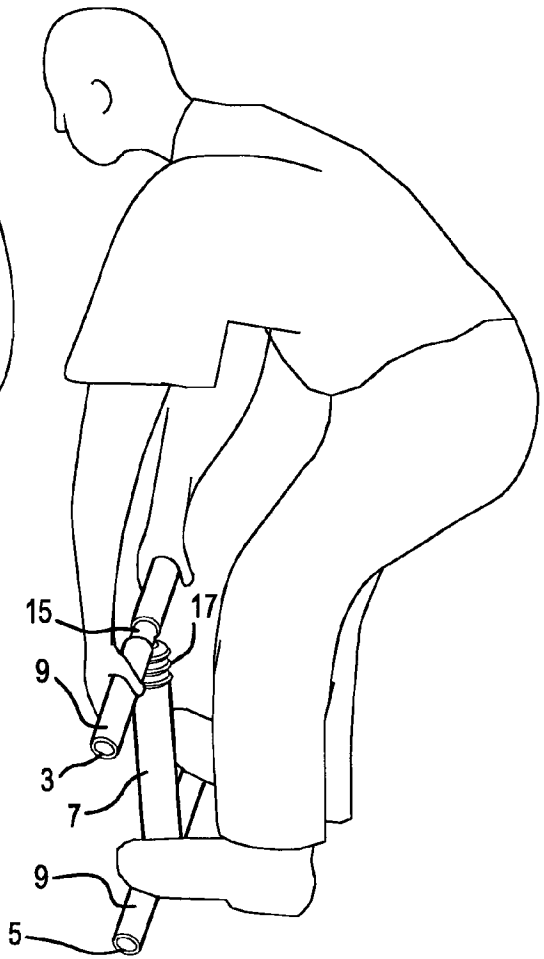

FIGS. 10*a* and 10*b* show an upright rowing machine. To perform upright rows with the present invention, the operator secures the lower bar 5 under the operator's feet. One foot is placed on each side of the ring 13 that connects the cylinder 7 to the lower bar 5. With the device fully compressed, the operator bends over and grips the upper bar 3 with palms facing the operator's legs. The operator pulls the piston 11 from the resistance cylinder 7 by standing up as far as possible with a rigid back position. For the compression stage, the operator bends over, pushing against the resistance until the piston 11 is completely inside the resistance cylinder 7. The process is repeated for the desired number of repetitions.

Figure 11B:
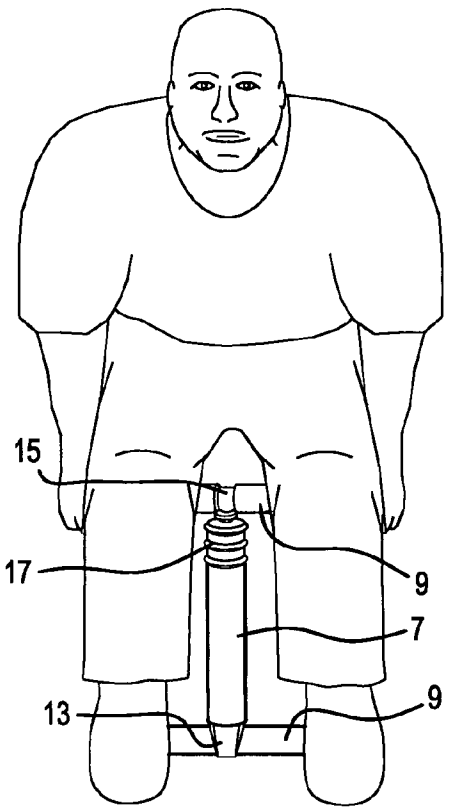
FIGS. 11*a* and 11*b* are illustrations of the exercise device being used for leg squats.
Figure 11A:
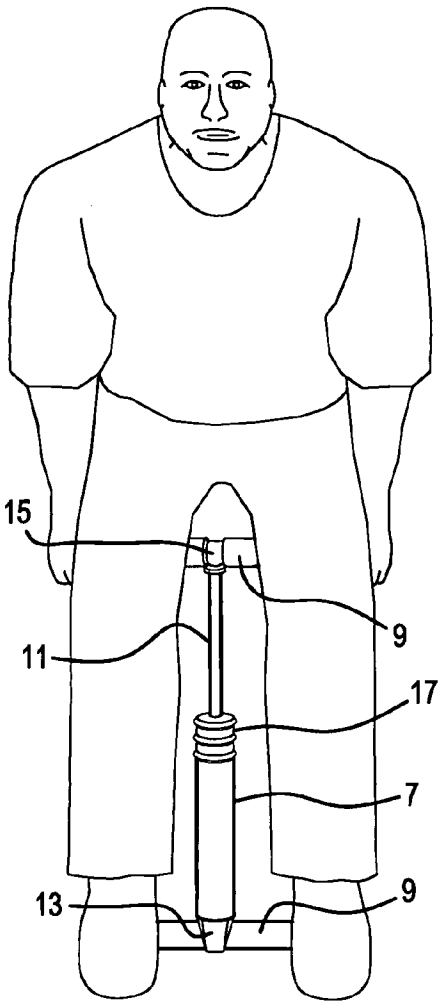

Finally, FIGS. 11*a* and 11*b* illustrate a leg squat machine. To perform leg squats with the present invention, the operator secures the lower bar 5 under the operator's feet. One foot is placed on each side of the ring 13 that connects the cylinder 7 to the lower bar 5. In contrast to upright rows, the upper bar 3 is located behind the operator's knees. With the device fully compressed, the operator bends down and grips the upper bar 3, with palms facing the operator's legs, behind the operator's knees. The operator pulls the piston 11 from the resistance cylinder 7 by standing up with a rigid back position. For the compression stage, the operator bends over, pushing against the resistance until the piston 11 is completely inside the resistance cylinder 7. The process is repeated for the desired number of repetitions.

Structural features of the new exercise device for abdominal, hips, lower back, arms and chest include:

two identical solid metal bars (2 to 3 feet long);

large, oversize foam padded handles;

air or oil filled hydraulic cylinder (no spring);

expansion and contraction resistance (push-pull resistance);

piston connected to upper bar;

cylinder connected to lower bar;

adjustable resistance;

staged resistance adjustment device on upper portion of hydraulic cylinder;

and the invention is portable and easy to store.

The invention also features new methods of performing exercises, including:

abdominal crunches;

bicep curls;

triceps presses;

chest flies;

upright rowing;

and leg squats.

While the invention has been described with reference to specific embodiments, modifications and variations of the invention may be constructed without departing from the scope of the invention, which is defined in the following claims.

I claim:

1. Exercise apparatus comprising:

first and second spaced parallel bars;

a double-acting sealed cylinder having first and second ends; the first end being closed and the second end having an opening with a seal for permitting sliding of a ram therethrough;

the first end of the cylinder connected centrally on the first bar;

a ram having a piston mounted in the cylinder and having a piston rod connected at a first end to the piston, the piston rod extending through the second end of the cylinder and having a second end connected centrally on the second bar;

resistance provided between the piston and the first and second ends of the cylinder for resisting movement of the piston and piston rod toward the first end and toward the second end with respect to the cylinder for moving the ram and increasing force in a fluid medium in one end of a cylinder and forcing fluid from the one end of the cylinder to the other end; a passage between the ends of the cylinder and a restriction in the passage for controlling flow of fluid between opposite ends of the cylinder;

gripping handles, relatively moving handles away from and toward each other and directly forcing a ram directly connected to one of the handles into and out of a hydraulic or pneumatic cylinder directly connected to the other one of the handles, and moving hydraulic or pneumatic fluid from one end to the other end of the cylinder with the relative movement of the handles and of the ram and the cylinder;

a grip provided on one of the bars for gripping the one bar with one or two hands of a user; and positions provided on another one of the bars for holding the other bar with one or both hands or with body members.

2. The apparatus of claim 1, further comprising fluid in the cylinder on opposite sides of the piston, and wherein the resistance comprises resistance to flow of fluid between opposite sides of the piston as the piston is moved through the cylinder.

3. The apparatus of claim 2, wherein the resistance is adjustable by varying flow rate of the fluid between the opposite sides of the piston.

4. The apparatus of claim 1, wherein the resistance is variable in response to varying force between the bars for extending the piston rod from the cylinder and moving the piston rod into the cylinder.

5. The apparatus of claim 1, wherein the resistance is variable in response to varying speed between the bars for extending the piston rod from the cylinder and moving the piston rod into the cylinder.

6. The apparatus of claim 1, wherein the fluid is oil and the cylinder is a hydraulic cylinder.

7. The apparatus of claim 1, wherein the fluid is air and the cylinder is a pneumatic cylinder.

8. The apparatus of claim 1, further comprising a flow passage between sides of the piston and a restrictor on the passage for restricting flow.

9. The apparatus of claim 8, wherein the restrictor is adjustable.

10. Exercise apparatus comprising:

a double-acting sealed hydraulic or pneumatic cylinder having opposite first and second ends, the first end being closed and the second end having an opening with a seal for permitting sliding movement of a ram therethrough, and having fluid sealed in the cylinder;

a ram mounted in the cylinder, the ram having a piston on a first end disposed within the cylinder, and the ram having a second end extending from the cylinder for moving the ram and increasing force in a fluid medium in one end of a cylinder and forcing fluid from the one end of the cylinder to the other end;

a passage between the ends of the cylinder and a restriction in the passage for controlling flow of fluid between opposite ends of the cylinder;

a first mounting ring on the first end of the cylinder;

a second mounting ring on the second end of the ram;

a first handle extending through the first mounting ring and having opposite equal length ends of the first handle on opposite sides of the first ring;

a second handle extending through the second ring and having opposite equal length ends of the second handle on opposite sides of the second ring; and foam padded handle grips, each respectively mounted on the ends of the first and second handles.

11. A method of exercising, comprising using the apparatus of claim 10 by gripping the handles, relatively moving the handles away from and toward each other and directly forcing a ram directly connected to the second handles into and out of a hydraulic or pneumatic cylinder directly connected to the first handles, and moving hydraulic or pneumatic fluid from one end to the other end of the cylinder with the relative movement of the handles and of the ram and the cylinder.

12. The method of claim 11, wherein the gripping of the first and second handles comprises gripping a first pair of handles on opposite ends of a first bar placed through a first ring on a closed end of the cylinder, and gripping a second pair of handles on opposite ends of a second bar placed through a second ring on an outer end of the ram.

13. The method of claim 12, wherein the gripping of the first pair of handles comprises placing the first pair of handles under knees of a user in a seated position, and wherein the gripping of the second pair of handles comprises gripping the second pair of handles with hands of a user near a chin and holding the hands in relative position to the chin, moving the first pair of handles by alternately bending a user's trunk forward and raising the trunk against fluid resistance of movement in the cylinder by the ram, thereby exercising the user's abdominal muscles.

14. The method of claim 12, wherein the gripping of the first pair of handles comprises placing the first pair of handles under knees of a user in a seated position, and wherein the gripping of the second pair of handles comprises gripping the second pair of handles with hands, palms facing inward, and holding a user's back straight and elbows stationary, raising and lowering the first pair of handles against fluid resistance of movement in the cylinder by the ram, and exercising the user's biceps.

15. The method of claim 12, wherein the gripping of the first pair of handles comprises placing the first pair of handles under knees of a user in a seated position, and wherein the gripping of the second pair of handles comprises gripping the second pair of handles with hands, palms facing outward, and holding a user's back straight and elbows stationary, lowering and raising the first pair of handles against fluid resistance of movement in the cylinder by the ram, and exercising the user's triceps and/or shoulders.

16. The method of claim 12, wherein the gripping of the first pair of handles comprises placing the first pair of handles under feet of a user in a standing position, and wherein the gripping of the second pair of handles comprises gripping the second pair of handles with hands, palms facing inward and knees slightly flexed, and deadlifting, raising and lowering the second pair of handles by lifting and lowering the user's back against fluid resistance of movement in the cylinder by the ram, exercising back and abdominal muscles in an upright rowing exercise.

17. The method of claim 12, wherein the gripping of the first pair of handles comprises placing the first pair of handles under feet of a user in a seated position, and wherein the gripping of the second pair of handles comprises gripping the second pair of handles with hands behind the user's knees and squatting and straightening the user's legs against fluid resistance of movement in the cylinder by the ram in a squat exercise.

18. The method of claim 12, further comprising gripping the first pair of handles with one hand near the first ring, gripping the second pair of handles with the other hand near the second ring, palms facing inward, and exercising chest and back muscles by pushing the first and second pairs of handles toward each other and pulling the first and second pairs of handles away from each other against fluid resistance of movement in the cylinder by the ram in chest flies.

19. The method of claim 12, further comprising twisting a collar on the cylinder in staged resistance steps for adjusting resistance in the cylinder.

20. The method of claim 12, further comprising adjusting resistance in the cylinder.

* * * * *

UNITED STATES PATENT AND TRADEMARK OFFICE

CERTIFICATE OF CORRECTION

PATENT NO. : 7,569,003 B1
APPLICATION NO. : 10/728961
DATED : August 4, 2009
INVENTOR(S) : Larry D. Huffman It is certified that error appears in the above-identified patent and that said Letters Patent is hereby corrected as shown below:

Title Page
Item (76) Inventor, should read:

--Larry D. Huffman, 239 Heritage Hill Trail, Louisville, KY 40223-5545--

Signed and Sealed this

Tenth Day of November, 2009

David J. Kappos

David J. Kappos
*Director of the United States Patent and Trademark Office*